United States Patent [19]

MacKenzie et al.

[11] 3,960,431

[45] June 1, 1976

[54] ELECTRICAL CONNECTOR

[75] Inventors: Morley Scott MacKenzie, Ottawa; Louis Donald Charron, Greely; Andrew Philip Charles Dooley, Ottawa; John Davidson Lee, Manotick, all of Canada

[73] Assignee: Nothern Electric Company Limited, Montreal, Canada

[22] Filed: July 21, 1975

[21] Appl. No.: 597,500

[52] U.S. Cl. ..... 339/98

[51] Int. Cl.[2] ..... H01R 9/08

[58] Field of Search ..... 339/95, 97–99

[56] References Cited

UNITED STATES PATENTS

| | | | |
|---|---|---|---|
| 2,359,541 | 10/1944 | Bancroft | 339/97 R |
| 3,078,434 | 2/1963 | Heinz-Pohl | 339/99 R |
| 3,162,501 | 12/1964 | Wahl | 339/98 |

*Primary Examiner*—Joseph H. McGlynn

*Attorney, Agent, or Firm*—Sidney T. Jelly

[57] ABSTRACT

A connector for electrically connecting electrical conductors having a housing within which is a holding member containing a preloaded spring, with an insulating cutting edge on the spring and an insulation cutting edge on the holding member, the cutting members acting in opposition on a conductor. Release of the spring, as by flexing the housing causes the cutting edges to cut through the insulation, into electrical contact with the conductor. A similar arrangement of cutting edges is provided for each conductor and a conductive path from one conductor to another is via the spring and/or holding member.

9 Claims, 12 Drawing Figures

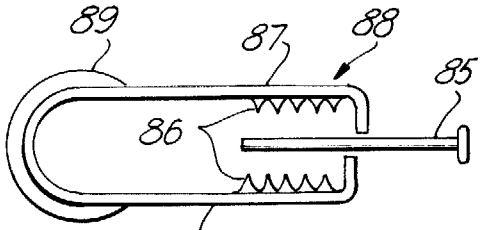
Fig. 12
Fig. 5
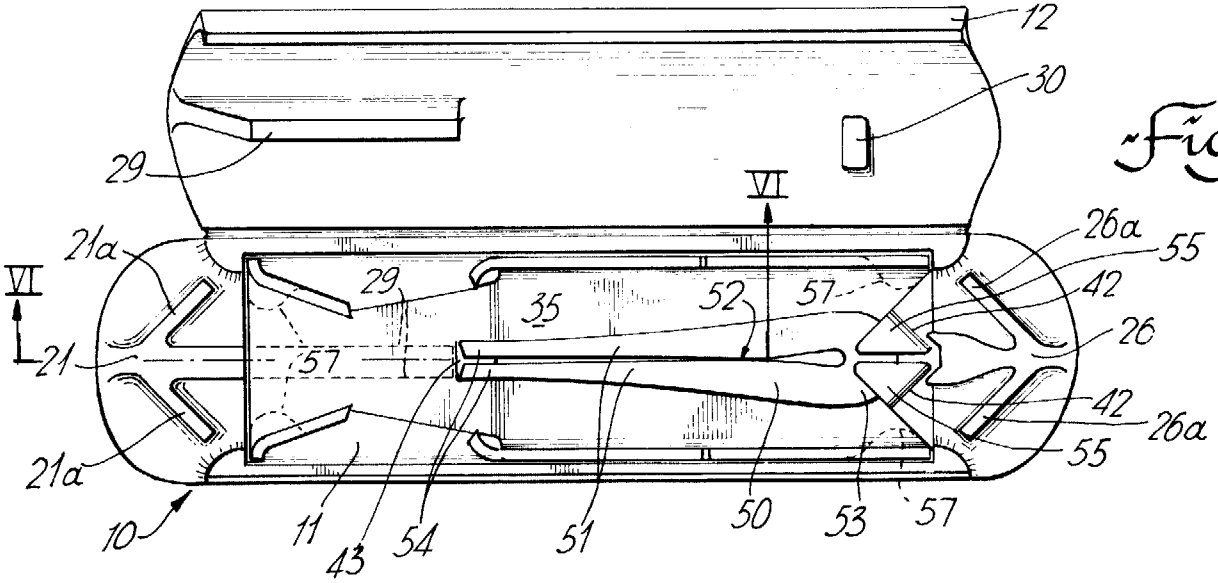
Fig. 6
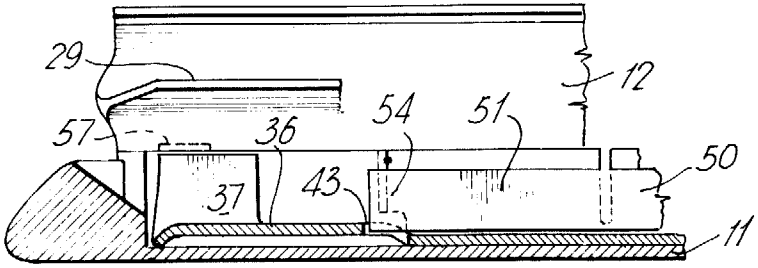

ELECTRICAL CONNECTOR

This invention relates to an electrical connector and in particular to a connector for electrically connecting two wires without the use of tools.

Conventional connectors generally require stripping of insulation from wires prior to insertion in the connector. A tool is also required, such as a screwdriver if the wires are clamped by threaded members, or a crimping tool if the wires are connected to each other, or to a common connecting member, by crimping.

The present invention provides for the electrical connection of wires in a connector by means of a spring which is in an inoperative position until required. After wires are inserted, the spring is used to provide the energy to pierce the insulation of the wires, and to provide electrical contact with the conductors. The compliance of the spring allows the connection of a wide range of conductor and insulation materials and sizes. Thus, in accordance with the present invention, an electrical connector comprises a housing having a base and a cover to define a hollow interior; a holding member in said housing and including a base and flange members extending from a plane including said base; a spring in said holding member, said spring retained in said holding member in a preloaded condition; a first insulation cutting edge on said spring and a second insulation cutting edge on said holding member; said second cutting edge positioned in opposition to said first cutting edge, the cutting edges positioned on opposite sides of a conductor path in said housing; the arrangement such that on release of said spring said first cutting edge is moved toward said second cutting edge with said cutting edges piercing insulation of a conductor and contacting with said conductor.

The invention will be readily understood by the following description of certain embodiments, by way of example in conjunction with the accompanying drawings, in which:

FIG. 5 is a view of the holding member assembled in the housing, and the spring in the holding member;

FIG. 6 is a cross-section on the line VI—VI of FIG. 5;

FIG. 12 is a plan view of an alternative form of spring which is preloaded to close inwardly on release.

Figure 1:
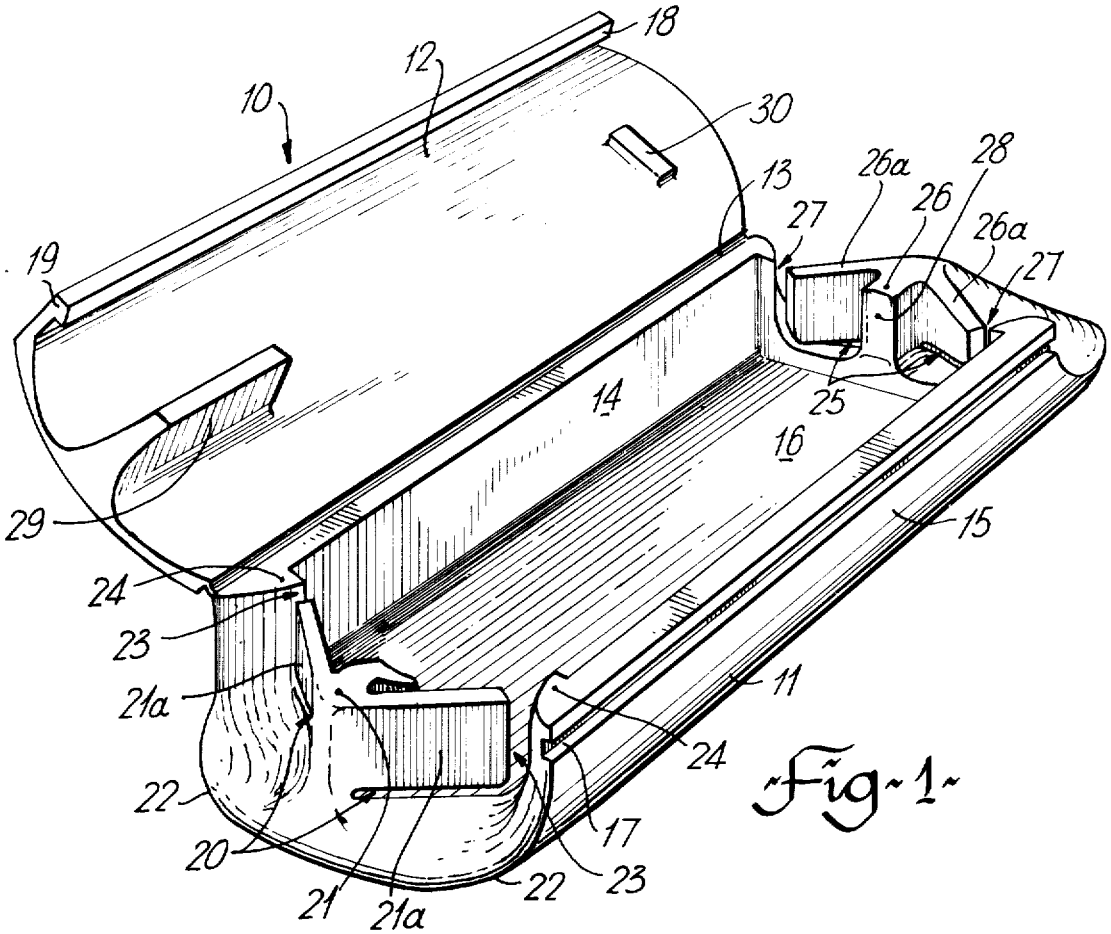
FIG. 1 is a perspective view of a housing for a connector.

FIG. 1 illustrates a housing 10, conveniently molded of a semi-rigid plastic material. The housing comprises a base 11 and a cover or lid 12, the cover, in the example illustrated, hingedly attached to the base 11 by a thin section 13.

The base 11 has upwardly extending flanges 14 and 15 extending along the sides of the bottom surface 16 to give the base a channel cross-section. The thin section 13 forming the hinge for the cover is formed at the top edge of one of the flanges 14. The flange 15, along the side spaced from flange 14, has a recess 17 along its outer surface for reception of a projection 18 on lip 19 of the cover. Engagement of the projection 18 in the recess 17 holds the cover closed. The cover can readily be opened by user's fingers.

At one end of the housing base is formed a divided inlet 20. The inlet is formed by a separating rib 21 positioned in the inlet at a central position and having outwardly extending, inwardly inclined legs 21*a*. The bottom surface is rounded at 22, and two narrow passages 23 are thus formed. Positioned slightly inwardly of the ends of the legs 21*a* are two projections 24, one on each side of the housing base. These projections act to position the spring holding member as will be described later.

At the end of the housing base remote from inlet 20 is formed a further divided inlet or opening 25. Situated in opening 25 is a further separating rib 26 having outwardly extending, inwardly inclined legs 26*a*, which define two narrow passages 27. At the centre of the separating rib 26 is formed an inwardly projecting formation 28 which acts to position the spring holding member also, as will be described.

On the inner surface of the cover 12 is provided a projection 29. The forward end of the projection is inclined and arranged to be slightly inwards of the inward end of separating rib 21 when the cover 12 is closed onto the housing base 11. Also on the inner surface of the cover 12 is a further projection 30 for holding the spring down in the holder.

Figure 2:
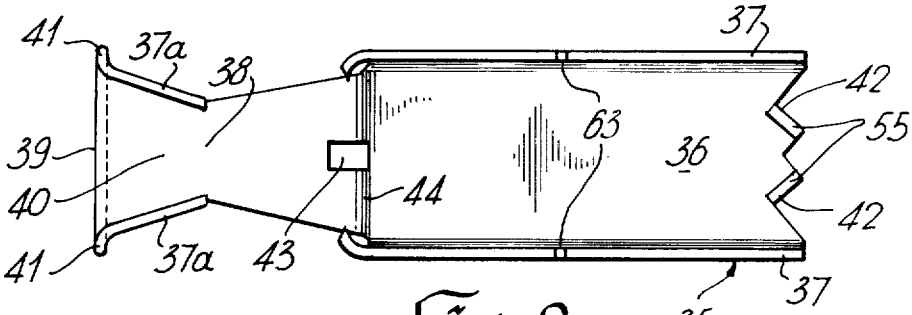
FIG. 2 is a plan view of a spring holding member for positioning in the housing of FIG. 1.
Figure 3:
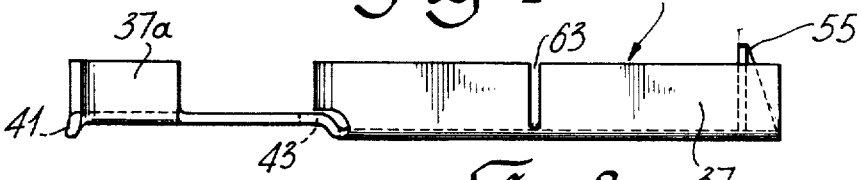
FIG. 3 is a side view of the holding member of FIG. 2.

FIGS. 2 and 3 illustrate a holding member 35. The holding member is formed of metal and is of channel cross-section having a base 36 and upwardly extending flanges 37 along the sides . Seen in plan view, as in FIG. 2, the holding member has a "waisted" shape being of reduced width at a position 38 towards one end. The flanges 37 are interrupted for part of the length of the member, extending from one end 39 towards the reduced width position 38, to form an inwardly tapered section 40, having flange portions 37*a*. The base then tapers outwardly from position 38 to the full width of the base, with no flanges 37 for this portion. To assist in the entry of wires, and to provide lateral support to the portions 37*a*, the ends of the flanges at end 39 are rounded, and the end of the base 36 is also rounded, as at 41.

At the end of the holding member remote from end 39, two upwardly extending buttresses 42 are formed, as by stamping or forming from the base 36. These buttresses form abutments for the spring, as will be described. At a position where flanges 37 restart — at the full width position at the end of the waisted shape or portion — there is formed an aperture 43 situated on the centre line of the holding member. The base 36 is also elevated for the waisted portion up to the end 39, the elevation starting at the side of the aperture 43 remote from the end 39. The line at which the elevation of the base starts is indicated at 44. This provides that the aperture 43 is in the base 36 at a position higher than the remainder of the base and the ends of the spring can be retained in this aperture, as will be described.

Figure 4:
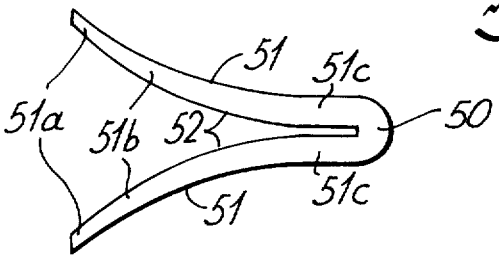
FIG. 4 is a plan view of one form of spring for the housing and holding member of FIGS. 1, 2 and 3, the spring in an unrestrained condition.

FIG. 4 illustrates a spring 50 having two tapered legs 51. As seen, the spring is bifurcated, or hair-pin form. The legs 51 are given a particular cross-section, and a particular form as viewed in FIG. 4, to give predetermined spring characteristics. Thus as illustrated in FIG. 4 each leg 51 has three sections — 51*a*, 51*b* and 51*c*. The junctions 52 between sections 51*b* and 51*c* form a pivot point and provide two differing load/deflection characteristics for the spring. This assists in providing good electrical connection for different sizes of wire, as will be described later. As seen in FIG. 4 the spring 50 is in the completely relaxed, or unloaded, condition.

FIGS. 5 and 6 illustrate the spring 50 assembled into the holding member 35 and the spring and holding member assembled into the housing. The spring 50 is first preloaded by a tool to bring the legs 51 into contact with each other at 51*a*, and then is positioned in the holding member. The curved or bent end 53 of the spring 50 rests against the abutments 42 and the ends 54 of the legs 51 fit into the aperture 43 (the sides of which are raised relative to the base surface 36 on which the spring rests). On release of the spring by the loading tool the spring legs are held in the loaded condition by the aperture 43. To ensure retention of the spring 50 in place in the holding member the top ends 55 of the abutments 42 can be bent over in contact. The position of the ends 54 of the legs 51 in the aperture 43 is illustrated in FIG. 6. The position of the wedge shaped projection 29, on the inside of the cover, when the cover is closed down, is indicated by dotted lines in FIG. 5.

For use the connector is provided in the form as illustrated in FIG. 5, that is with the spring 50 mounted in the holding member 35, in a loaded condition, the holding member 35 in the housing 10. The cover 12 would be closed down on the base 11 to retain the holding member in position. To use, there is no need to open the cover 12. Conductors can be inserted from either end of the connector. Thus two conductors can be inserted at one end or at the other end. Alternatively one conductor can be inserted at one side at one end and at the other side at the other end. In either of these alternatives there will be the equivalent of an end to end electrical connection. As a further alternative two conductors can extend right through the connector, and thus there will be provided electrical connection at a position intermediate the ends of both conductors. Finally one conductor may extend right through the connector and one conductor may be inserted from one end or the other, to provide an electrical connection of one conductor to a mid-position on another conductor. A conductor extending right through the connector is inserted from the top with the housing cover 12 open.

When severe tension forces are applied to the wires, it is possible that they will move in an undesirable manner, for example upwards. To avoid this it is possible to form flaps at each end of the housing, as are indicated in dotted outline at 57 in FIGS. 5 and 6.

Figure 7:
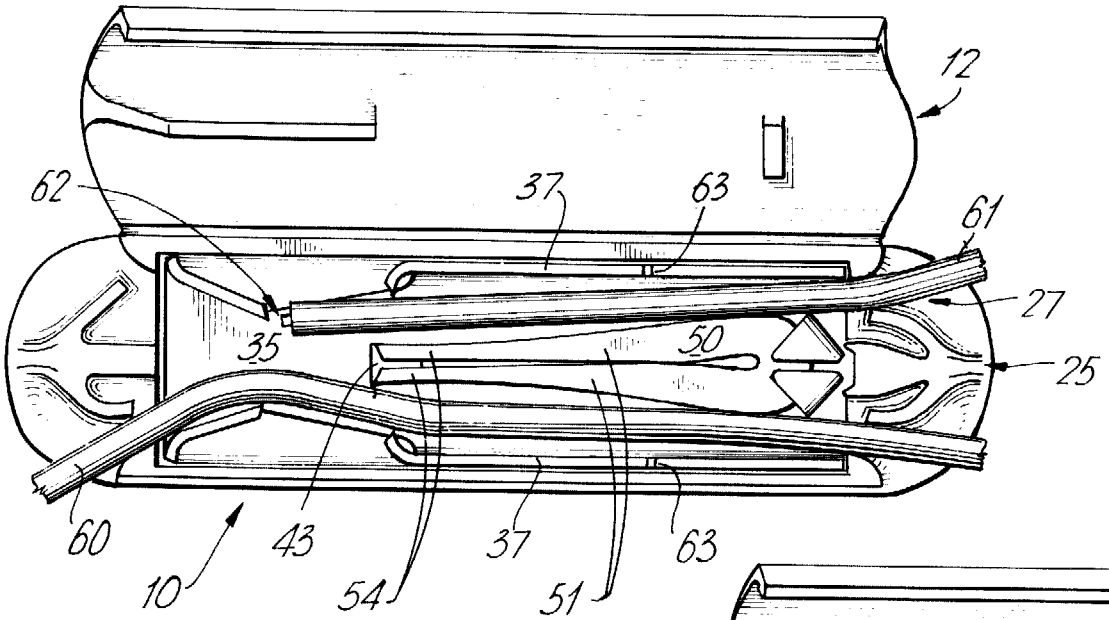
FIG. 7 is a plan view of the connector with one configuration of wires inserted prior to release of the spring.

FIG. 7 illustrates an arrangement in which one electrical conductor 60 extends right through the connector and another electrical conductor 61 is inserted at end 25 via one opening 27. Each conductor comprises a central conductive core — indicated at 62 for conductor 61, with an insulating coating. The conductor 60 inserted from the top as stated above, extends along one side of the connector, passing along one side of the spring 50.

With the conductors in position, as in FIG. 7, the cover 12 is closed and the spring 50 is deployed by bending the housing 10 about a transverse axis and at the same time flexing the holding member 35 about the same axis. Such flexing can be expedited by forming slots 63, one in each flange 37, of the holding member 35. However, these slots are not essential. Flexing of the holding member 35 lifts the ends 54 of the legs 51 of the spring 50 out of the aperture 43 and the legs 51 spring apart, as seen in FIG. 8.

The amount by which the legs 51 move is decided by the size of the conductors. For relatively large conductors, as in FIG. 8, the legs 51 spring apart at the sections 51*b*. For smaller conductors, the sections 51*c* would also open. A greater loading is imposed on the conductor in the condition illustrated in FIG. 8, than when the legs open further and including sections 51*c*. It can be arranged that the legs touch at more than one position, and can provide a moving fulcrum.

Figure 8:
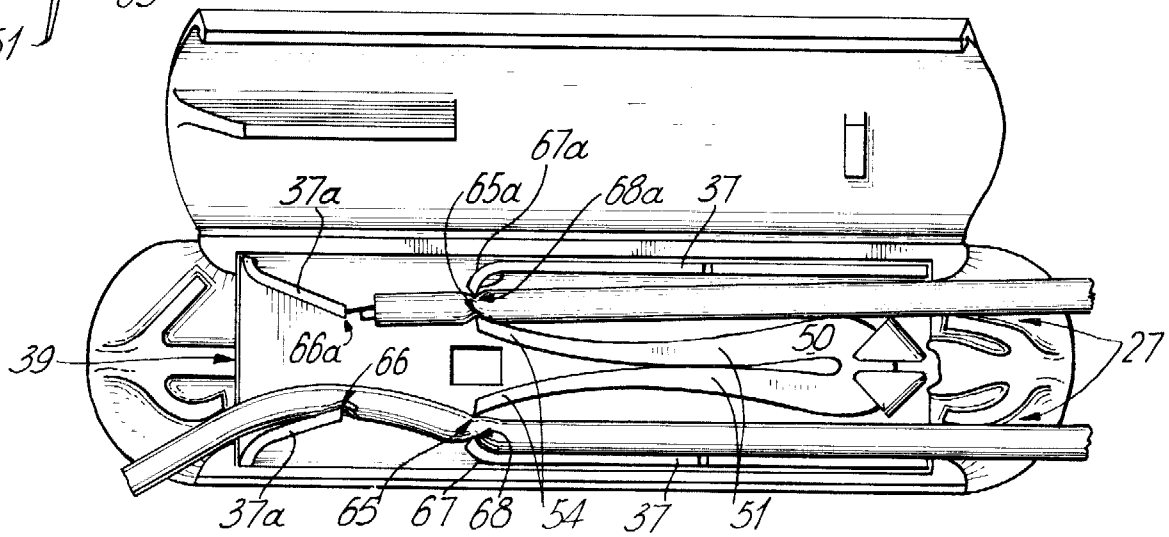
FIG. 8 is a plan view of the connector with wires inserted and after release of the spring.

It will be seen from FIG. 8 that the ends 54 of the legs 51 of the spring 50 are formed with cutting or piercing edges 65 and 65*a*. Also the ends of the flange portions 37*a* remote from end 39, are shaped to provide cutting or piercing edges 66 and 66*a*. Finally the ends of the main portions of flanges 37, remote from the openings 27 are curved inward at 67 and 67*a* and formed with cutting or piercing edges 68 and 68*a*.

The relative positions of one set of edges, for example edges 65, 66 and 68, and the particular angles of the intersecting faces that form these edges, are important in that the degree of penetration of the conductor is determined by these parameters. The degree of penetration of the conductor will affect the electrical resistance and the mechanical strength of the connection.

Figure 9:
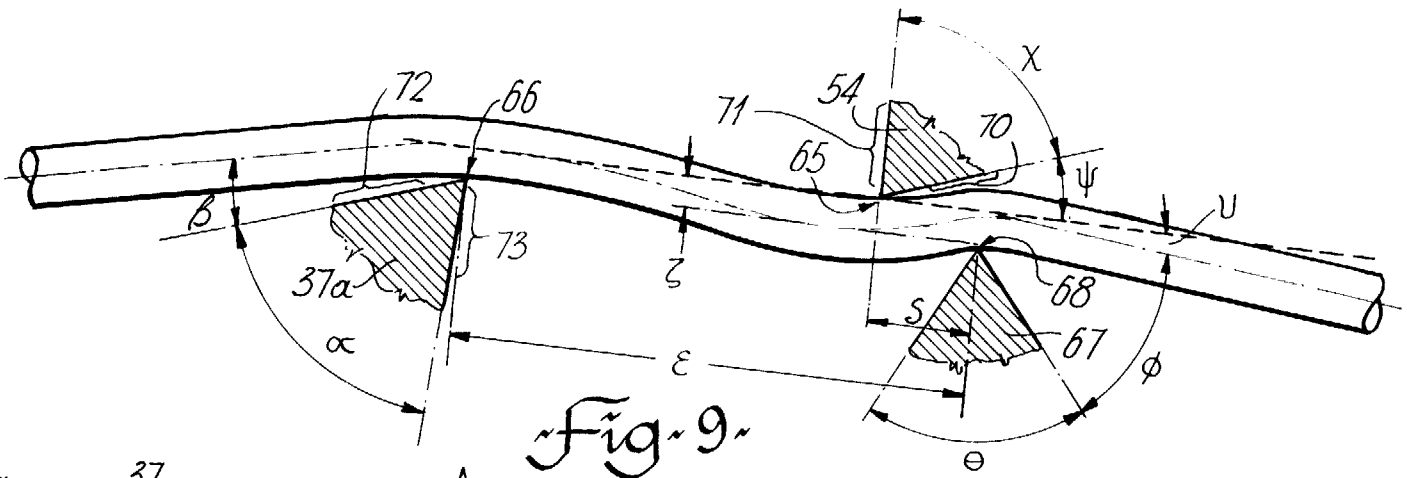
FIG. 9 is a diagrammatic view illustrating the relevant angles of the various parts of the spring and holding member.

FIG. 9 is a diagrammatic plan view of one set of cutting or piercing edges, with various parameters indicated. The included angle of the edge 65 or the end of the spring leg 54 is $\chi$, the included angle of the edge 66, at the end of the flange section 37*a* is $\alpha$ and the included angle of the cutting edge 68 on the end of the main portion of the flange 67 is $\theta$. Other angles of interest are (a) the angle $\phi$ subtended by the end 67 of the flanges 37 and the longitudinal axis of the section of the conductor immediately adjacent to the edge 68 extending towards the end of the connector — 25; (b) The angle $\beta$ subtended by the face 72 of the member 37*a* and the section of the conductor immediately adjacent to the edge 66 extending towards the end 20 of the connector; (c) The angle $\psi$ subtended by the face 70 of the end 54 of member 50 and the mean path of the conductor between edges 66 and 68.

The distance of edge 66 from edge 68 is "$\epsilon$", and the displacement of edge 65 relative to edge 68 measured in the direction of a line drawn between edge 68 and edge 66, is "$\delta$" the perpendicular distance of edge 65 from the line drawn between edge 68 and edge 66 is $\zeta$.

The remaining parameters, not shown on FIG. 9, are (a) The spring rate $\sigma$ of the spring member 50; (b) The path described by edge 65 as the spring is released; (c) The kinetic energy of the legs 51 of the spring 50 manifest at the edge 65 when this edge impinges on the conductor; (d) The variation of angle $\psi$ subtended by the face 70 of the section 54 and the mean path of the conductor between edges 66 and 68, with the distance of edge 65 from a line drawn between edges 66 and 68; (e) The hardness of the base materials of sections 54 and 67 and the end of flange 37*a*, and the plating, if any, applied to the conductor contacting areas.

The angles $\alpha$, $\theta$ and $\chi$ may be limited by the hardness of the base material to maintain well defined edges, that are not deformed under applied loads. The angle $\phi$, the sum of angles $\phi+\theta$, the angle $\psi$, and the sum of angles $\psi$ and $\chi$ are important in determining to a large extent the penetration of edges 68 and 65 into the conductor. The minimum penetration that is necessary will be dependant in part upon the material of the conductor, the required resistance to slippage of the conductor when pulled in the direction of the end 25 of the connector and the required electrical resistance of contacts between edge 65 and the conductor and between edge 68 and the conductor, when combined in parallel. The maxiumum penetration that is desirable will be dependant in part upon the tendency of the conductor to be severed between the edge 68 and the face 70 or the edge 65. Optimum penetration is achieved when the electrical resistance of contacts is satisfactory and, when the conductor is pulled towards the end 25 of the connector, the conductor slips for a short distance then holds to a maximum load.

The resistance to slippage is aided, in part, by the torturous route of the conductor through the edges. The bending of the conductor round the edges causes there to be a substantially radial reaction between the conductor and the edges which is proportional to the tension in the conductor, the edges thus bite further into the conductor to arrest the tendency of the conductor to slip. The self servo action described above is used at edge 66 to resist conductor pull-out in the direction of the end 20 of the connector. Before the above tension is applied to the conductor, it is not necessary that the edge 66 pierce any insulation that may cover the conductor. The angles subtended by the faces 72 and 73 and the section of the conductor immediately adjacent to the edge 66 extending in the direction of the end 20 of the connector are important in that $\alpha$ should be kept to a minimum consistent with the hardness of the material of the end of flange 37*a* and ease of production of this edge so that the edge 66 will bite into the wire without undue slippage of the conductor past this edge. The optimum value of angle $\beta$ lies between a minimum value at which the reaction between the conductor, or conductor insulation and face 72 tends to stop edge 66 biting into the conductor and a maximum value at which the sum of $\beta + \alpha$ reduces the rake of face 73, allowing the conductor to skim over the edge 66.

Similarly at edge 68 the angles $\chi$ and $\psi$ are important. $\chi$ should be kept to a minimum consistent with the ability of the material of spring member 50 to hold a clean edge and the ease of producing this edge. The optimum value of angle $\psi$ lies above a minimum value at which the pressure of conductor insulation or the conductor itself against face 70 hinders edge 65 penetrating the conductor to stop slippage of the conductor pulled in the direction of end 25 of the connector. The optimum value of $\psi$ lies below a maximum value at which the sum of $\chi + \psi$ reduces the rate of face 71 relative to the conductor so that the edge 65 tends to ride over the conductor.

The ends 67 of flanges 37 are substantially wedge shaped. This shape requires little energy to pierce any insulation or insulating film that is on the conductor and has the additional advantage that the area of contact between the contact and conductor increases as the contact sinks into the conductor. This increase in area increases the resistance to penetration and helps regulate the distance of penetration.

Angles $\theta$, $\phi$, $\nu$ and $\psi$ are all important to the action of this contact. Angle $\theta$ is chosen to give good electrical contact with minimum energy requirement. The angles $\psi$, $\nu$, and $\phi$ are chosen so that the bisector of angle $\theta$ is approximately normal to the surface of the conductor at edge 68, and to the face 70 of member 50 and approximately parallel to the path described by edge 65 as member 50 is released. Thus $\frac{1}{2}\theta + \phi + \nu < 90 < \frac{1}{2}\theta + \phi + \nu + \psi$.

Dimensions $\epsilon$ and $\delta$ are important in relation to the various reaction forces between the various contacts and the conductor. They are also important in achieving the serpentine shape of the conductor on release of the spring.

The dimension $\zeta$ will be primarily dependant upon the gauge of the conductor.

The spring value $\sigma$, and the clearance, or interference between ends 54 of spring 50 and the ends 68 of flanges 37 are important in determining the degree of penetration of the contacts into the conductor.

The path described by edge 65 as the spring is released, should after contact with the conductor, be approximately normal to the conductor at edge 65, so that, the axial movement of the conductor during connection is minimal and so that any axial load applied externally to the conductor does not tend to open or close the spring.

The kinetic energy of the legs 51 when edge 54 impinges on the conductor is important in that the instantaneous pressure between contacts and the conductor is higher at the moment of connection than during the service life of the connector. This is useful in reducing creep in the conductor, in service.

The following are typical values of the parameters described above. These values are suitable for the connection of 26 – 19 a.w.g. copper conductors or 17 – 20 a.w.g. aluminum conductors. The maximum diameter over insulation of the conductor is 0.065 inches. Typical insulations are polyethylene, solid/or foam; polyprolyene; paper, pulp or ribbon

| | | |
|---|---|---|
| Angles: | $\alpha$ | 60° |
| | $\beta$ | 20° |
| | $\chi$ | 60° |
| | $\psi$ | 15°–20° |
| | $\nu$ | −7° or 353° |
| | $\phi$ | 57° |
| | $\theta$ | 45° |
| Dimensions: | $\epsilon$ | .180'' |
| | $\delta$ | .020'' |
| | $\zeta$ | Will be dependant upon conductor gauge and insulation type and diameter. = .000'' – .005'' with 26 awg copper conductor = .030'' – .040'' with 19 awg copper conductor |

Other parameters; $\sigma$ the spring rate of the spring 50 should be 60 lbf/in.

When the spring is released without conductors in the connnector, the static force between the face 70 and the edge 68 should be 2/lbf.

The path described by the edge 65 on release of the spring, is such that $0.017 < \delta < 0.035$.

Suitable materials for member 50 are Beryllium Copper — C.D.A. 172, stainless steels — 440 C or 17 — 7 P.H.

Suitable materialsfor sections 37 and 67 are Phosphor Bronze C.D.A. 510, Aluminum Bronze CDA 638, Copper alloy CDA 195, or Beryllium copper alloys.

Figure 10:
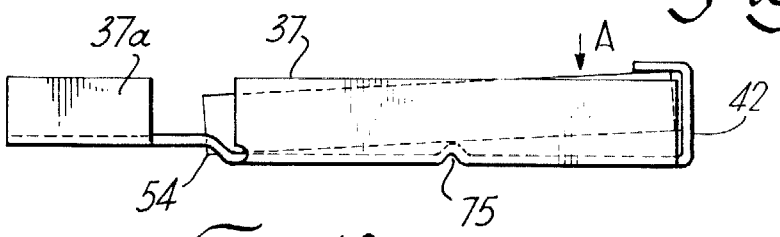
FIG. 10 is a cross-section, similar to that of FIG. 3, illustrating an alternative spring release arrangement.

In the example so far described, the spring 50 is released by bending or flexing of the holding member. FIG. 10 illustrates an alternative mounting of the spring in the holding member 35. The spring is held in the preloaded position, as in FIGS. 5 and 6, by the ends 54 being positioned in aperture 43. At a position intermediate the aperture 43 and the abutments 42, a projection 75 is formed in the base 36 of the holding member. The spring rests on the projection 75 and is thus slightly tilted, as seen in FIG. 10. The spring 50 is deployed, when the cover 12 is closed, by pressing on the cover at a position approximating that indicated by the arrow A. This pushes down the end of the spring and releases the ends 54 from the aperture 43. To assist in pushing down on the spring a button may be molded into the cover 12, or a protrusion can be molded on the inner surface of the cover.

In a further alternative, the spring may be deployed by sliding it along the longitudinal axis of the holding member, to release the ends of the spring from the aperture. The sliding of the spring can be by a button extending through the base of the holding member and housing or through the lid of the housing. In such an arrangement the housing need not necessarily be flexible.

Figure 11:
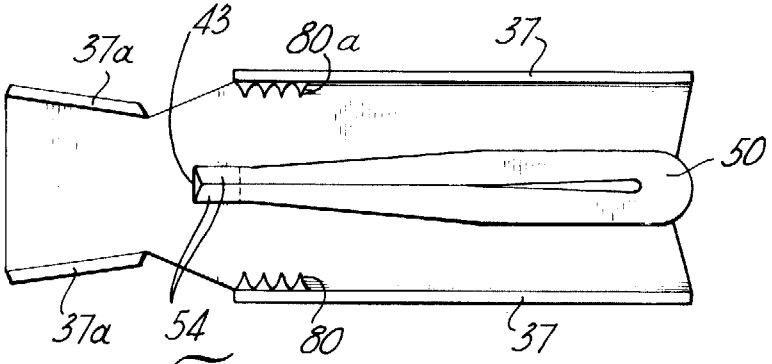
FIG. 11 is a plan view of spring and holding member with alternate form of contacts.

Instead of forming the cutting edges 68 and 68*a*, it is possible to form tangs in the flanges 37. This is illustrated in FIG. 11. Tangs 80 and 80*a* are formed — by punching a four-sided point through the flanges 37. When the spring 50 is deployed the tangs 80 and 80*a* pierce the insulation and make electrical contact with the conductor.

It is also possible for the spring to be preloaded inwards, instead of outwards as described above. In such an arrangement the legs of the spring would be held apart until deployed. A similar holding member 35 as in FIGS. 2 and 3 could be used, except that two laterally spaced apart apertures are provided, one for each end of a leg of the spring. Bending or flexing of the holding member would release the spring legs which would move towards each other. Inwardly facing cutting edges would be formed on the ends of the legs of the spring. In this arrangement the conductor, or conductors extend between the legs of the spring.

For the arrangement of an inwardly preloaded spring, the legs of the spring can be held open by other means, such as a member inserted between the legs of the spring and removed after insertion of the conductors.

Conveniently, with inwardly preloaded springs, the legs would be spaced apart slightly at the closed end. FIG. 12 is a plan view of one example using a pin 85 to hold the legs open. In the example illustrated in FIG. 12, tangs 86 are formed on the inside surface of the legs 87 of the spring 88. The closed end of the spring can be embossed, at 89, for increased strength.

The invention provides a simple, effective and economic connector. No tools are required for applying the connector, an easy and quick bending of the connector after insertion of the conductors effecting connection. There are no loose parts as the connector is stored and applied in the closed condition.

While the present invention has been described more specifically in relation to relatively small diameter conductors such as are used in communication systems, the invention is also applicable to conductors of larger diameters, for example as are used in power supply. e.g. domestic and industrial. The invention is also applicable to stranded conductors, particularly as used for power supply.

What is claimed is:

1. An electrical connector, comprising:

a housing having a base and a cover to define a hollow interior;

a holding member in said housing and including a base and flange members extending from a plane including said base;

a spring in said holding member, said spring retained in said holding member in a preloaded condition;

a first insulation cutting edge on said spring and a second insulation cutting edge on said holding member;

said second cutting edge positioned in opposition to said first cutting edge, the cutting edges positioned on opposite sides of a conductor path in said housing;

the arrangement such that on release of said spring said first cutting edge is moved toward said second cutting edge with said cutting edges piercing insulation of a conductor and in contact with said conductor.

2. A connector as claimed in claim 1, said cover hingedly attached to said housing along one side of said base.

3. A connector as claimed in claim 1, said spring being of bifurcated form and including two legs joined at a joint at one end, said first cutting edge comprising an insulation cutting edge at the other end of each leg;

a conductor path along each side of said spring; and a second cutting edge on said holding member opposed to each of said first cutting edges.

4. A connector as claimed in claim 3, said housing including an inlet at each end, each inlet divided to provide access to said conductor paths, the joint between the legs of said spring adjacent to one inlet, and third cutting edges on said holding member, one for each path, said third cutting edges positioned between said first and second cutting edges and the other of said inlets.

5. A connector as claimed in claim 3, said legs of said spring being arcuate in form in a released condition, said legs being in contact at positions successively remote from said joint as said legs are preloaded.

6. A connector as claimed in claim 3, said holding member including means in engagement with said spring at said joint to maintain said spring in said holding member.

7. A connector as claimed in claim 3, including inwardly extending portions on said flange members of said holding member, said second cutting edges formed on said inwardly extending portions.

8. A connector as claimed in claim 3, said first cutting edges, on said spring, retained in an aperture in said holding member, said spring released by deflection of said cutting edges out of said aperture.

9. A connector as claimed in claim 8, said housing being made of flexible material, said spring released by bending of said housing to distort said holding member.

* * * * *